United States Patent [19]

Cummings

[11] Patent Number: 4,781,083

[45] Date of Patent: Nov. 1, 1988

[54] RATCHET KEY CHUCK TOOL

[76] Inventor: Henry G. Cummings, 208 Plymouth St., Holbrook, Mass. 02343

[21] Appl. No.: 69,298

[22] Filed: Jul. 2, 1987

[51] Int. Cl.[4] ..... B25B 13/46

[52] U.S. Cl. ..... 81/63.1; 81/482

[58] Field of Search ..... 81/58.3, 63.1, 16, 467, 81/57.39, 58.3, 58.4, 58.2, 63, 482, 483; 279/1 K, 1 B

[56] References Cited

U.S. PATENT DOCUMENTS 4,534,573 8/1985 Somers ..... 81/16

FOREIGN PATENT DOCUMENTS 0880710 11/1981 U.S.S.R. ..... 81/467

0006435 of 1910 United Kingdom ..... 81/58.3

*Primary Examiner*—Frederick R. Schmidt

*Assistant Examiner*—Lawrence Cruz

*Attorney, Agent, or Firm*—Herbert L. Bello

[57] ABSTRACT

A ratchet chuck key tool with a torque indicator for tightening and loosening a chuck. The device includes a one-way ratchet having a ratchet wheel, a pawl and a handle. The pawl, which is connected to the handle, drivingly engages and disengages the ratchet wheel as the handle is reciprocated. A shaft is connected to and rotates with ratchet wheel. A pair of chuck keys are mounted on opposite ends of shaft. One chuck key tightens a chuck and the other chuck key loosens a chuck, the handle being moved in the same direction for tightening and loosening of the chuck. One chuck key defines a purchase for turning the other chuck key and making the chuck finger tight. A torque indicator associated with the pawl provides an indication that the force required to rotate the handle and turn the chuck keys exceeds a predetermined torque level.

13 Claims, 2 Drawing Sheets

RATCHET KEY CHUCK TOOL

BACKGROUND OF THE INVENTION

1. Field of the Invention:

The present invention relates to tools and, more particularly, is directed to a ratchet having a pair of chuck keys.

2. Description of the Prior Art:

A chuck key is a well-known tool that is used for tightening a chuck. The chuck key has a fixed bevel gear on one end of a key shaft, the gear being configured to engage a like bevel gear on the chuck. The chuck key has a rod that is perpendicular to the key shaft and defines a purchase for turning the chuck key to loosen or tighten the chuck. A ratchet is a well-known tool that is used for tightening and loosening bolts, screws and the like.

There are many chuck wrench configurations in the prior art as well as hand held ratchet tools. For example, U.S. Pat. Nos. 2,826,950 and 4,467,677 show chuck wrenches and U.S. Pat. No. 1,970,409 shows a ratchet tool. U.S. Pat. No. 4,386,879 discloses a permanently mounted chuck key that ratchets.

SUMMARY OF THE INVENTION

It is an object of the present invention to provide an improved chuck key device for tightening and loosening of a chuck.

It is another object of the present invention to provide a ratchet chuck key tool with a one-way ratchet and having a pair of chuck keys.

It is a further object of the present invention to provide a ratchet chuck key tool with a pair of like sized chuck keys and having a torque indicator. The tool includes a one-way ratchet, having a ratchet wheel, a pawl and handle. The pawl, which is connected to the handle, is constrained for yielding engagement with the ratchet wheel. The pawl is in driving engagement with the ratchet wheel when the handle is rotated in a first direction and the pawl is out of driving engagement with the ratchet wheel when the handle is rotated in an opposite direction. A shaft is mounted to the center of the ratchet wheel, the axis of the shaft being coaxial with the axis about which the handle rotates. A chuck key is mounted to each end of the shaft, the shaft and chuck keys rotating with the rotation of the ratchet wheel when it is driven by rotation of the handle. The chuck keys are configured to fit the same size chuck. The chuck is tightened when engaged by one of the chuck keys and the handle is rotated in the first direction and the chuck is loosened when engaged by the other chuck key and the hand is rotated in the first direction. A torque indicating mechanism operatively connected to the pawl and handle provides an indication that the force applied to the handle for driving the ratchet wheel exceeds a preset level.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
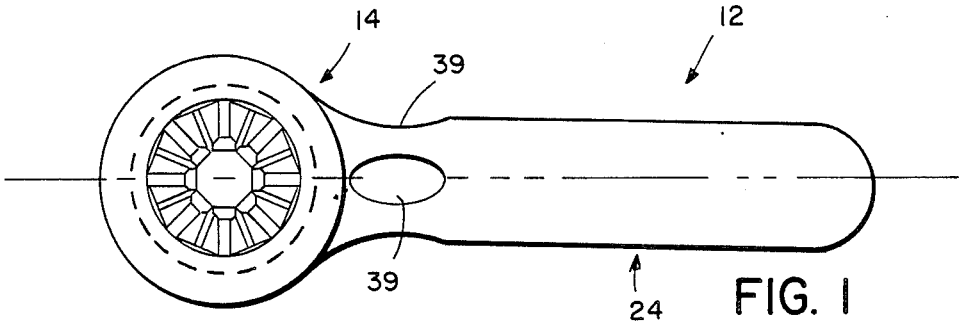
FIG. 1 is a plan view of a ratchet chuck key tool embodying the invention.
Figure 2:
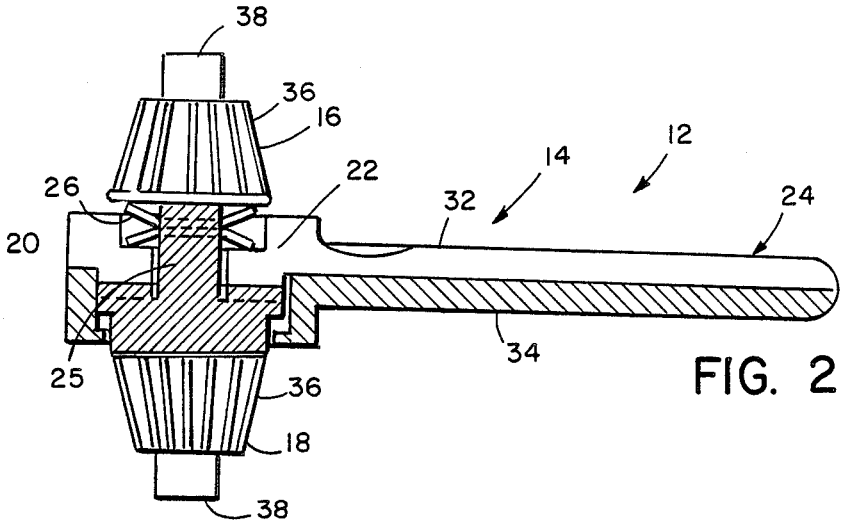
FIG. 2 is a cross-sectional view of the chuck key tool of FIG. 1.

Referring now to the drawings, particularly FIGS. 1 and 2, there is shown a chuck key tool 12 made in accordance with the teachings of the present invention. Chuck key 12 includes a one-way ratchet 14 and a pair of chuck keys 16 and 18. One-way ratchet 14 includes a ratchet wheel 20, a pawl 22 and a handle 24. Chuck keys 16 and 18, are drivingly connected to a shaft 25 that extends from the center of ratchet wheel 20 at the rotational axis thereof. A biasing member 26, for example a spring washer, urges pawl 22 against ratchet wheel 20.

Figure 3:
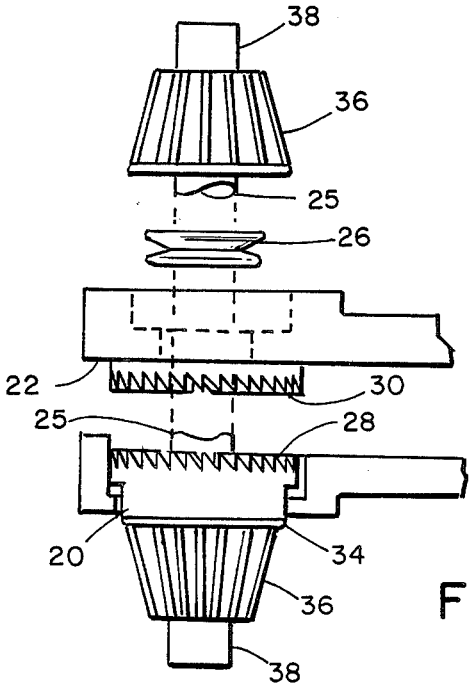
FIG. 3 is an exploded view of the chuck key tool of FIG. 1.

As shown in FIG. 3, ratchet wheel 20 has a face gear 28 and pawl 22 has a face gear 30. Face gear 30 is adapted to mesh and be in driving engagement with the face gear 28 when handle 24 is turned in one direction and face gear 30 moves relative to face gear 28 when the handle is turned in the opposite direction.

In the illustrated embodiment of FIG. 2, handle 24 is composed of two sections 32 and 34. Section 32 is connected to pawl 22 and section 34 is a guide/retainer section that holds the ratchet wheel 20 and pawl 22 in alignment. Section 32 and section 34 of handle 24 are firmly and captively held together to form a single handle. As best shown in FIG. 1, handle 24 is formed with thumb or finger indentations 39.

Each chuck key 16 and 18 includes a bevel gear 36 that is adapted to engage a like bevel gear on a chuck (not shown). The chuck keys 16 and 18 are sized to fit the same sized chuck. A stem 38 extends outwardly from the bevel gears 36, the stem being configured to fit into a matching hole in the chuck.

As previously indicated, the face gear 30 of pawl 22 is in driving engagement with the face gear 28 of ratchet wheel 20 when handle 24 is rotated in one direction. The face gears 30 and 28 of pawl 22 and ratchet wheel 20, respectively, are out of driving engagement when handle 24 is rotated in the opposite direction. As shown in FIG. 2, when handle 24 is turned in the driving direction, for example in the clockwise direction about the longitudinal axis of shaft 25, chuck keys 16 and 18 rotate, and face gear 28 is in driving engagement with face gear 30. When handle 24 is turned in the non-driving or counterclockwise direction, the teeth of the face gear 30 of pawl 22 move relative to the teeth of face gear 28 of ratchet wheel 20. When the handle is moved in the driving direction, chuck keys 16 and 18 rotate with the ratchet wheel 20. When handle 24 is moved in the non-driving direction, chuck keys 16 and 18 will remain stationary when a slight holding force is applied to either one of the chuck keys. When key 16 is inserted into a chuck to be tightened and handle 24 is rotated in the driving direction, chuck 16 rotates to tighten the chuck. If the chuck is extremely loose, it is possible to make it finger tight by manually rotating chuck key 18 in the counterclockwise or non-driving direction relative to chuck 16. That is, chuck key 18 is a purchase for turning chuck key 16. When chuck key 18 is hand turned in this direction, the face gears of ratchet wheel 20 and pawl 22 do not mesh and the ratchet wheel rotates while the handle 24 remains stationary. If chuck key 18 is inserted into a chuck, and handle 24 is rotated in the driving direction, the chuck will be loosened. That is, the driving direction of handle 24 is always the same whether the chuck is to be tightened or loosened. Chuck key 16 is used to tighten a chuck and chuck key 18 is used to loosen a chuck.

Figure 4:
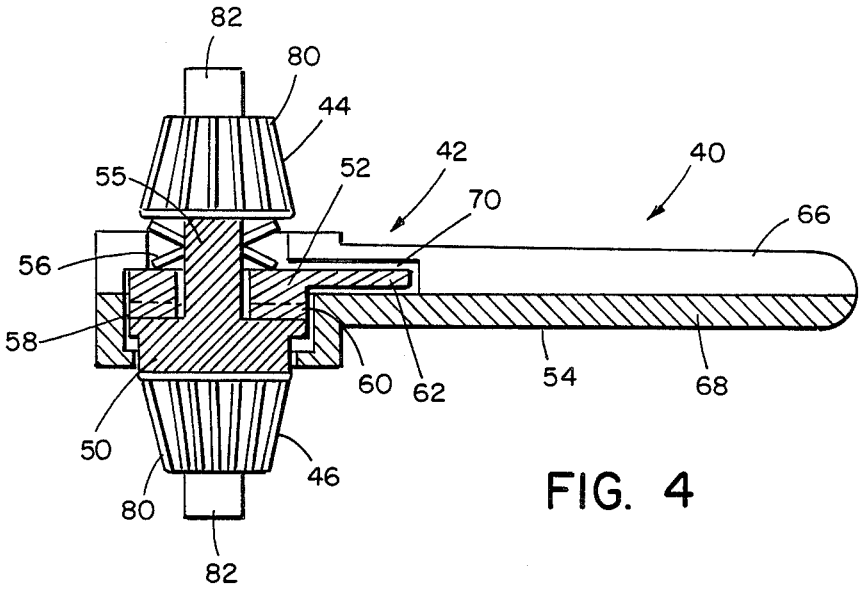
FIG. 4 is a side view, in cross section, of a chuck key tool with a torque indicator embodying the invention.
Figure 5:
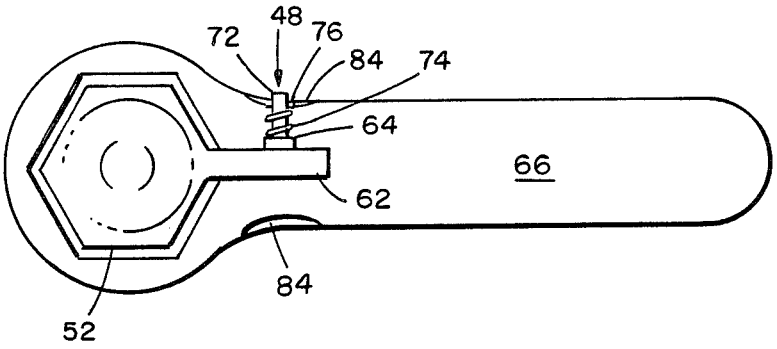
FIG. 5 is a plan view, in cross section, of the chuck key tool of FIG. 3 and shows details of the torque indicator.

Referring now to FIGS. 4 and 5, there is shown a chuck key tool 40, which is an alternate embodiment of the present invention. Chuck key 40 includes a one-way ratchet 42, a pair of chuck keys 44 and 46, and a torque indicator 48. One-way ratchet 40 includes a ratchet wheel 50, a pawl 52 and a handle 54. Chuck keys 44 and 46, which are configured to fit the same chuck size, are drivingly connected to a shaft 55 that extends from ratchet wheel 50. A biasing member 56, for example a spring washer, urges pawl 52 against ratchet wheel 50. Ratchet wheel 50 has a face gear 58 and pawl 52 has a face gear 60. Face gear 60 is adapted to mesh and be in driving engagement with face gear 58 when handle 54 is turned in one direction and face gear 60 moves relative to face gear 58 when the handle is turned in the opposite direction. As best shown in FIG. 5, pawl 52 has an extending arm 62 and a finger 64. Finger 64 projects outwardly from arm 64 and points the direction that handle 54 is rotated for loosening a chuck.

Handle 54 is composed of two sections 66 and 68. Section 66 is provided with a compartment 70 that is sized to receive arm 62 and finger 64. A hole 72, which is formed in the sidewall of handle 54, is in alignment with finger 64 and is sized to permit the finger to project outwardly of the handle. A bias spring 74, is fitted about finger 64 and a washer 76 is positioned between spring 74 and hole 72. Section 68 is a guide/retainer section that cooperates with section 66 to hold ratchet wheel 50 and pawl 52 in alignment with each other. Handle sections 66 and 68 are fitted together and captively held to form a single handle. As best shown in FIG. 5, handle 54 is formed with thumb or finger indentations 84.

Each chuck key 44 and 48 includes a bevel gear 80 that is adapted to engage a like bevel gear on a chuck (not shown). A stem 82 extends outwardly from the bevel gears 80, the stem being configured to fit into a matching hole in the chuck.

The face gear 60 of pawl 52 is in driving engagement with the face gear 58 of ratchet wheel 50 when handle 54 is rotated in one direction about the longitudinal axis of shaft 55, for example the clockwise direction as shown in FIG. 5. The face gear 60 of pawl 52 and the face gear 58 of ratchet 50 are out of driving engagement when handle 54 is rotated in the opposite or counter-clockwise direction. When handle 54 is turned in the driving direction about the longitudinal axis of shaft 55, face gears 58 and 60 mesh and chuck keys 16 and 18 rotate. When handle 54 is turned in the non-driving direction, the teeth of the face gear 60 of pawl 22 moves relative to the teeth of the face gear 58 of ratchet wheel 20. Chuck keys 44 and 46 will remain stationary when a slight holding force is applied to either one of the chuck keys when handle 54 is moved in the non-driving direction. When key 44 is inserted into a chuck to be tightened, and handle 54 is rotated in the driving direction, chuck 44 rotates to tighten the chuck. The force exerted by bias spring 74 against arm 62 is sufficient to hold finger 64 in its initial position and the finger remains within handle 54 or projects slightly through hole 72. As the torque required to turn either chuck key 66 or 68 increases beyond the force required to compress bias spring 74 and the spring compresses, finger 64 projects out of hole 72 and provides an indication that a predetermined torque level has been exceeded. The predetermined torque level is established by force required to compress bias spring 74.

If the chuck is extremely loose, it is possible to make it finger tight by manually rotating chuck key 46. When chuck key 46 is turned in this manner, the face gears of ratchet wheel 50 and pawl 52 move relative to each other, the ratchet wheel rotates and handle 54 remains stationary. If chuck key 46 is inserted into a chuck, and handle 54 is rotated in the driving direction, the chuck will be loosened. That is, the driving direction of handle 54 is always the same whether the chuck is to be tightened or loosened. Chuck key 44 is used to tighten a chuck and chuck key 46 is used to loosen a chuck.

Some certain changes may be made in the foregoing disclosure without departing from the scope of the invention herein involved, it is intended that all matter contained in the above description be construed in an illustrative and not in a limiting sense. For example, in alternate embodiments, the ratchet wheel and pawl are other than face gears, for example, the ratchet wheel is a toothed wheel or gear and the pawl is a pivoted tongue or sliding bolt.

What is claimed is:

1. A tool for tightening and loosening a chuck, said tool comprising:

(a) a one-way ratchet having a ratchet wheel, a pawl, tension means and a handle, said handle connected to said pawl, said tension means yieldably holding said pawl in driving engagement with said ratchet wheel when said handle is rotated in a first direction, said pawl being out of driving engagement with said ratchet wheel when said handle is rotated in a second direction;

(b) a shaft connected to said ratchet wheel, said handle rotatable about a longitudinal axis of said shaft; and (c) a chuck key mounted on each end of said shaft;

(d) the chuck is tightened when engaged by one of said chuck keys and said handle is rotated in said first direction;

(e) the chuck is loosened when engaged by the other of said chuck keys and said handle is rotated in said first direction.

2. A tool for tightening and loosening a chuck, said tool comprising:

(a) a one-way ratchet having a ratchet wheel, a pawl and a handle, said handle connected to said pawl, said pawl is in driving engagement with said ratchet wheel when said handle is rotated in a first direction, said pawl is out of driving engagement with said ratchet wheel when said handle is rotated in a second direction;

(b) a tension spring yieldably acting on one of said ratchet wheel and said pawl to hold said ratchet wheel and said pawl in driving engagement when said handle is rotated in said first direction and to permit said ratchet wheel to remain stationary when said handle is rotated in said second direction;

(c) a shaft connected to said ratchet wheel, said handle rotatable about a longitudinal axis of said shaft; and (d) a chuck key mounted on each end of said shaft;

(e) the chuck is tightened when engaged by one of said chuck keys and said handle is rotated in said first direction;

(f) the chuck is loosened when engaged by the other of said chuck keys and said handle is rotated in said first direction.

3. The tool as claimed in claim 1 wherein said chuck keys are sized to fit the same chuck.

4. A tool for tightening and loosening a chuck, said tool comprising:

(a) a one-way ratchet having a ratchet wheel, a pawl and a handle, said handle connected to said pawl, said handle including a first section and a second section, said first section connected to said pawl, said first and second sections cooperating to define a guide for holding said ratchet wheel and said pawl in alignment, said pawl is in driving engagement with said ratchet wheel when said handle is rotated in a first direction, said pawl is out of driving engagement with said ratchet wheel when said handle is rotated in a second direction;

(b) a shaft connected to said ratchet wheel, said handle rotatable about a longitudinal axis of said shaft; and (c) a chuck key mounted on each end of said shaft, said chuck keys configured to fit the same chuck;

(d) the chuck is tightened when engaged by one of said chuck keys and said handle is rotated in said first direction;

(e) the chuck is loosened when engaged by the other of said chuck keys and said handle is rotated in said first direction.

5. A tool for tightening and loosening a chuck, said tool comprising:

(a) a one-way ratchet having a ratchet wheel, a pawl and a handle, said handle connected to said pawl, said handle including a first section and a second section, said first section connected to said pawl, said first and second sections cooperating to define a guide for holding said ratchet wheel and said pawl in alignment, said pawl is in driving engagement with said ratchet wheel when said handle is rotated in a first direction, said pawl is out of driving engagement with said ratchet wheel when said handle is rotated in a second direction;

(b) a shaft connected to said ratchet wheel, said handle rotatable about a longitudinal axis of said shaft; and (c) a chuck key mounted on each end of said shaft;

(d) the chuck is tightened when engaged by one of said chuck keys and said handle is rotated in said first direction;

(e) the chuck is loosened when engaged by the other of said chuck keys and said handle is rotated in said first direction.

6. A tool for tightening and loosening a chuck, said tool comprising:

(a) a one-way ratchet having a ratchet wheel, a pawl and a handle;

(b) said ratchet wheel having a face gear and said pawl having a face gear, said face gears in registration;

(c) torque means connected between said handle and said pawl, said torque means including an arm, a finger and a spring, said arm is connected to said pawl and said finger is mounted to said arm, said arm is movable relative to said handle, said spring is operatively connected to said arm for biasing said arm in said first direction, a hole formed in said handle is sized and shaped to permit at least a portion of said finger to pass through said hole and provide an indication that the force applied to said handle to rotate said ratchet wheel has overcome the force applied by said spring against said arm and has exceeded a preset torque level, (d) a shaft connected to said ratchet wheel at the center of said face gear of said ratchet wheel, said handle rotatable about a longitudinal axis of said shaft; and (e) a chuck key mounted on each end of said shaft;

(f) the chuck is tightened when engaged by one of said chuck keys and said handle is rotated in said first direction;

(g) the chuck is loosened when engaged by the other of said chuck keys and said handle is rotated in said first direction.

7. A tool for tightening and loosening a chuck, said tool comprising:

(a) a one-way ratchet having a ratchet wheel, a pawl and a handle;

(b) torque means connected between said handle and said pawl, said torque means including an indicator to provide an indication that the force applied to said handle to rotate said ratchet wheel exceeds a preset level, a driving force applied to said handle is transmitted to said pawl by means of said torque means, said pawl is in driving engagement with said ratchet wheel when said handle is rotated in a first direction, said pawl is out of driving engagement with said ratchet wheel when said handle is rotated in a second direction;

(c) a shaft connected to said ratchet wheel, said handle rotatable about a longitudinal axis of said shaft; and (d) a chuck key mounted on each end of said shaft;

(e) the chuck is tightened when engaged by one of said chuck keys and said handle is rotated in said first direction;

(f) the chuck is loosened when engaged by the other of said chuck keys and said handle is rotated in said first direction;

(g) said torque means including an arm, a finger and a torque spring, said arm is connected to said pawl, said finger is mounted to said arm, said torque spring is operatively connected to said arm, said arm is movable relative to said handle, said torque spring is operatively connected to said arm for biasing said arm in said first direction, a hole formed in said handle is sized and shaped to permit at least a portion of said finger to pass through said hole and provide an indication that the force applied to said handle to rotate said ratchet wheel has overcome the force applied by said torque spring against said arm and has exceeded a preset torque level.

8. The tool as claimed in claim 7 including a tension spring yieldably acting on one of said ratchet wheel and said pawl to hold said ratchet wheel and pawl in driving engagement when said handle is rotated in said first direction and to permit said ratchet wheel to remain stationary when said handle is rotated in said second direction.

9. The tool as claimed in claim 8 wherein said chuck keys are sized to fit the same chuck.

10. The tool as claimed in claim 9 wherein said handle includes a first section and a second section, said first section connected to said pawl, said first and second sections cooperating to define a guide for holding said ratchet wheel and pawl in alignment.

11. The tool as claimed in claim 6 including a tension spring yieldably acting on one of said ratchet wheel and said pawl to hold said ratchet wheel and pawl in driving engagement when said handle is rotated in said first direction and to permit said ratchet wheel to remain stationary when said handle is rotated in said second direction.

12. The tool as claimed in claim 11 wherein said chuck keys are sized to fit the same chuck.

13. The tool as claimed in claim 12 wherein said handle includes a first section and a second section, said first section connected to said pawl, said first and second sections cooperating to define a guide for holding said ratchet wheel and pawl in alignment.

* * * * *